US008586135B2

(12) United States Patent
Taniguchi et al.

(10) Patent No.: US 8,586,135 B2
(45) Date of Patent: Nov. 19, 2013

(54) METHOD FOR MANUFACTURING A COLORED ELECTRIC WIRE

(75) Inventors: Moriatsu Taniguchi, Shizuoka (JP); Keigo Sugimura, Shizuoka (JP); Takeshi Kamata, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 1170 days.

(21) Appl. No.: 12/219,574

(22) Filed: Jul. 24, 2008

(65) Prior Publication Data

US 2009/0056852 A1 Mar. 5, 2009

(30) Foreign Application Priority Data

Sep. 5, 2007 (JP) ..... 2007-229684

(51) Int. Cl.
*H01B 13/06* (2006.01)

(52) U.S. Cl.
USPC ..... 427/117

(58) Field of Classification Search
USPC ..... 427/175, 96.2, 117, 96.5
See application file for complete search history.

(56) References Cited

U.S. PATENT DOCUMENTS

| | | | | |
|---|---|---|---|---|
| 3,229,623 | A | 1/1966 | Rubinstein et al. | |
| 3,836,702 | A * | 9/1974 | Plummer | 174/92 |
| 4,708,887 | A | 11/1987 | Baxter et al. | |
| 5,444,466 | A * | 8/1995 | Smyczek et al. | 347/4 |
| 6,906,264 | B1 * | 6/2005 | Grant et al. | 174/112 |
| 2007/0141379 | A1 * | 6/2007 | Kim | 428/607 |

FOREIGN PATENT DOCUMENTS

| | | | |
|---|---|---|---|
| EP | 0415674 | A2 | 3/1991 |
| EP | 0415674 | A3 | 3/1991 |
| JP | 59-232770 | A | 12/1984 |
| JP | 09-115364 | * | 5/1997 |
| JP | 09-115364 | A | 5/1997 |
| JP | 2005-346973 | A | 12/2005 |
| JP | 2006-049228 | | 2/2006 |
| WO | WO-2006-016511 | | 2/2006 |

OTHER PUBLICATIONS

English Abstract of JP60104308 dated Jun. 8, 1985; Database WPI Week 198529, Thomson Scientific, London, GB; AN 1985-175069 (1 page).
English Abstract of JP09115364 dated May 2, 1997; Database WPI Week 199728, Thomson Scientific, London, GB; AN 1997-303796 (1 page).
European Search Report dated May 17, 2010, issued on the corresponding European Patent Application No. 08160874.7.
Office Action for Japanese Patent Application 2007-229684 issued Nov. 6, 2012.

* cited by examiner

*Primary Examiner* — Michael Cleveland
*Assistant Examiner* — Tabassom Tadayyon Eslami
(74) *Attorney, Agent, or Firm* — Edwards Wildman Palmer LLP

(57) ABSTRACT

An electric wire whose outer surface has a portion to be colored as required is manufactured by forming a plurality of recesses on the portion of the outer surface of the electric wire, which has a core wire and an insulating jacket that covers an entire periphery of the core wire, and then applying a coloring material to the portion of the outer surface of the electric wire. The recesses may be provided by blowing abrasive grains against the portion or by pricking the portion with one or more needles.

2 Claims, 3 Drawing Sheets

METHOD FOR MANUFACTURING A COLORED ELECTRIC WIRE

FIELD OF THE INVENTION

The present invention relates to a method for manufacturing a colored electric wire, and particularly to a method for manufacturing an electric wire having an outer surface a portion of which is colored.

DESCRIPTION OF THE RELATED ART

An automotive wiring harness has numerous electric wires that serve to supply electric power to and transmit control signals and other operational information between electronic and electrical components of an automobile. The electric wire is made of an electrically conductive core wire covered by an insulating jacket, with a connector attached to an end of the core wire.

The electric wire is obtained by first cutting the electric wire in a predetermined length, attaching a terminal fitting to the end of the electric wire, inserting the terminal fitting into a housing of the connector, and then connecting the connector to a connector of the electronic or electrical component so as to deliver the electric power to and/or exchange control information between the components.

As the automobile incorporates an increasing number of and various types of the electronic and electrical components, the wiring harness has to integrate an increasing number of the electric wires, and it is of importance to color an outer surface of the electric wires with coloring materials applied to a portion of the outer surface of the electric wire so that the electric wires that have different functions can be distinguished from each other when assembling the wiring harness or for maintenance purpose (for example, refer to the Japanese Patent Application Laid-Open Publication No. 2006-49228).

However, a drawback of the electric wire that has undergone a coloring process is that the coloring material comes off the electric wire due to bending or friction of the electric wire. This drawback causes another drawback that the numerous electric wires are hard to identify during maintenance and/or possibly manufacturing of the wiring harness.

SUMMARY OF THE INVENTION

In view of the above identified problems, an object of the present invention is to provide a method for manufacturing a colored electric wire that ensures improved adhesiveness of a coloring material applied to and retained on an outer surface of the electric wire.

It is therefore a feature of an embodiment of the present invention to is provide a method for manufacturing a colored electric wire having the outer surface a portion of which is colored, which includes the successive steps of forming recesses upon the portion of the outer surface, and then applying the coloring material to the portion of the outer surface on which the recesses has been formed, thus obtaining the colored electric wire.

According to the method of the present invention, since the portion of the outer surface of the electric wire is colored by applying the coloring material to the recesses that has been formed on the portion of the outer surface, adhesiveness of the coloring material applied to and retained on the portion of the outer surface can be enhanced by virtue of an anchor effect, thus protecting the coloring material against coming off the outer surface of the electric wire. The coloring material retained in the recesses facilitates the identification of the types of the colored electric wires even when the coloring material has come off the electric wire due to the outer surface being rubbed.

Preferably, the recesses are provided by blowing abrasive grains against the portion of the outer surface. By virtue of this feature, it is possible to continuously feed the electric wire and form the recesses without stoppage or interruption of operation, and manufacturability of the colored electric wire will be improved.

As an alternative to application of the abrasive grains, the recesses may be provided by pricking the portion of the outer surface with a needle. Incorporation of this alternative feature allows accurate control of properties of the recesses such as a depth and a number of the recesses.

BRIEF DESCRIPTION OF THE DRAWINGS

These and other objects, features, and advantages of the present invention will become more apparent upon reading of the following detailed description along with the accompanied drawings, in which.

DESCRIPTION OF THE PREFERRED EMBODIMENT

A method for manufacturing a colored electric wire according to a first embodiment of the present invention is described in detail with reference to FIGS. 1 to 4.

Figure 1:
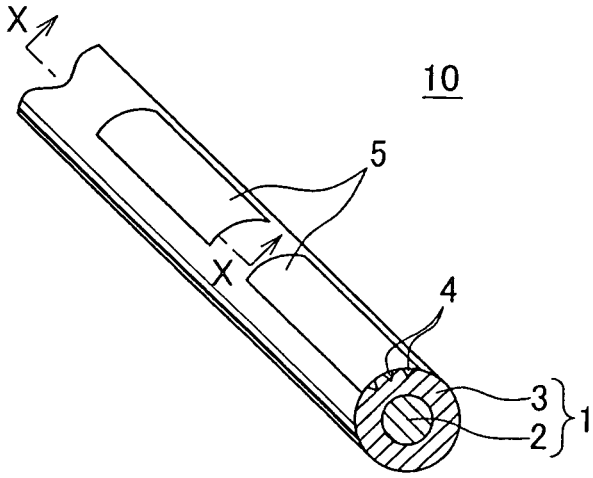
FIG. 1 is a perspective view of a colored electric wire manufactured according to the method of the present invention.
Figure 2:
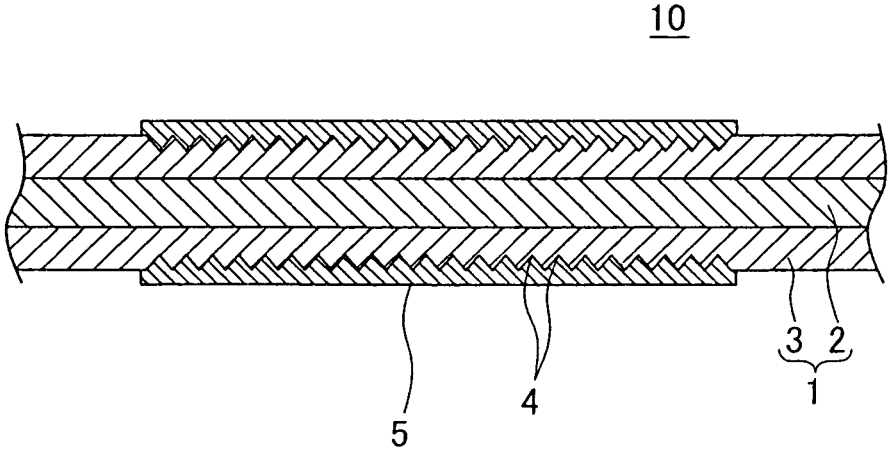
FIG. 2 is a cross-sectional view taken along the line X-X of FIG. 1.
Figure 4:
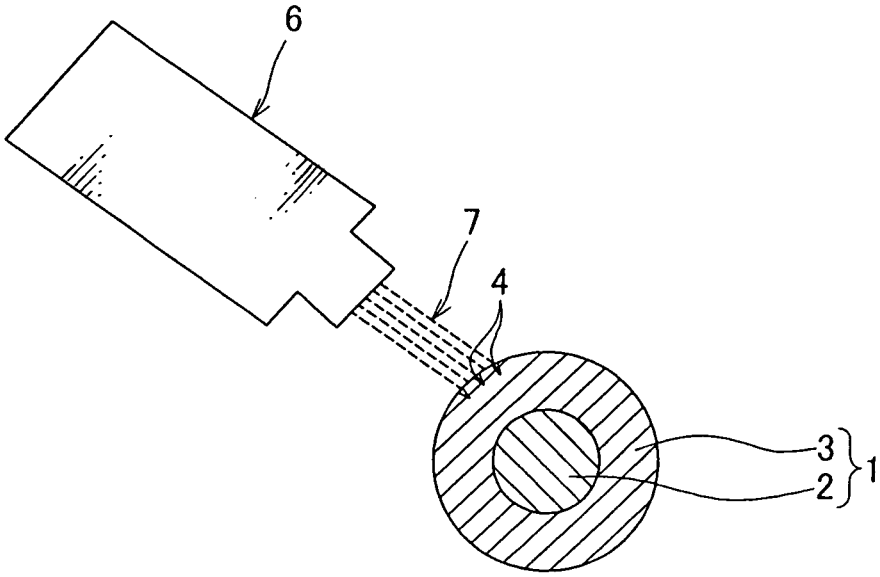
FIG. 4 illustrates the method for manufacturing the colored electric wire of FIG. 1 according to a first embodiment of the present invention.

The method for manufacturing the colored electric wire according to the first embodiment of the present invention forms recesses 4 on a portion of an outer surface of the electric wire using a shot-blasting unit 6 illustrated in FIG. 4, and then a coloring unit (not shown) applies a coloring material 5 to the portion of the outer surface having the recesses, and thus a colored electric wire 10 illustrated in FIGS. 1 and 2 is obtained. Also, the colored electric wire 10 is used as a constituent part of an automotive wiring harness to supply electric power to and transmit control signals and/or other information between electronic or electrical components.

Referring to FIG. 1 illustrating a perspective view of the colored electric wire manufactured according to the method of the present invention, the electric wire 1 of the colored electric wire 10 has an electrically-conductive core wire 2 which is a stranded lead wire, and an insulating jacket 3 that covers the core wire 2. In this specification, the electric wire that is not colored by a coloring process is simply called "electric wire 1", while the electric wire 1 that has been colored is referred to as "colored electric wire 10."

The jacket 3 is made of a synthetic resin such as polyvinylchloride (PVC). The synthetic resin of the jacket 3 is colored with a desired color obtained by using one or more coloring materials. Also, the synthetic resin of the jacket 3 may be colorless or uncolored without use of any coloring materials. In this specification, a color of the jacket 3 that is not colored with the coloring material is called "ground color" ("ji-iro" in Japanese). Note that, for the sake of explanation, the outer surface of the electric wire 1 is also referred to as the outer surface of the jacket 3 or the outer surface of the colored electric wire 10 where appropriate in this specification.

Referring to FIG. 2 showing a cross-sectional view taken along the line X-X of FIG. 1, recesses 4 (which may be small holes, dents, pits, dimples or indentations, for example) are formed on a portion of the outer surface of the jacket 3 by a shot-blasting unit 6 which will be explained later. Thus, irregularity (a predetermined degree of roughness or asperity) of surface due to existence of the recesses 4 is imparted to the portion of the outer surface of the jacket 3. Also, the recesses 4 are formed on the outer surface of the jacket 3 radially inwardly toward the center of the core wire 2. A depth of the recess 4 is restrained such that the recess 4 does not penetrating the jacket 3 so as not to reach the core wire 2.

Note that the term "portion of the outer surface" denotes a specific section that is to be colored. To be more specific, the portion of the outer surface of the jacket 3, on which the recesses 4 are formed, is the specific section of the outer surface that is to be colored with a coloring material 5. The coloring material 5 has a color different from the ground color of the jacket 3. The coloring material 5 is used to provide a colored mark on the outer surface of the jacket 3. The mark is in a shape of a line extending in a longitudinal direction of the electric wire 1. The coloring material 5 may be made of a pigment and a solvent in which the pigment is dispersed. It is preferable that the coloring material 5 has affinity for the synthetic resin that the jacket 3 is made of.

Figure 3:
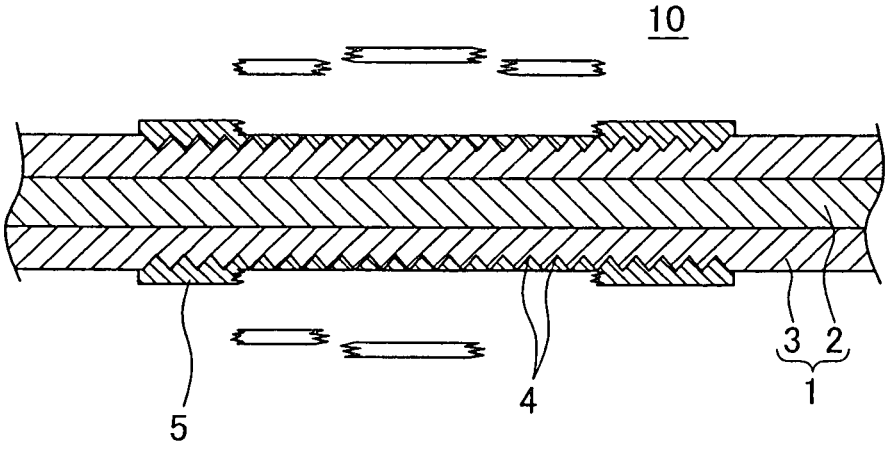
FIG. 3 is a cross-sectional view of the colored electric wire of FIG. 2, where the coloring material came off the colored electric wire.

According to the present invention, the colored electric wire 1 is obtained by forming recesses 4 on the portion of the outer surface of the electric wire 1, and then applying the coloring material to the portion on which the recesses 4 have been formed. An anchor effect produced by the coloring material 5 retained in the recesses 4 ensures more reliable adhesiveness of the coloring material 5 to the outer surface, thus preventing the coloring material 5 from coming off the electric wire 1. Also, even when the coloring material 5 is lost due to friction of the outer surface, as can be seen in FIG. 3, the coloring material 5 is effectively kept in the recesses 4, so that the colored electric wire 10 can be identified with ease and accuracy.

Also, a colored-electric-wire manufacturing device directed to implementing the method for manufacturing the colored electric wire 10 has the shot-blasting unit 6 illustrated in FIG. 4, a coloring unit (not shown) that blows and distributes the coloring material 5 against the outer surface of the electric wire 1, and a wire supply unit (not shown) that feeds and moves the electric wire 1 in the longitudinal direction of the electric wire 1.

Referring to FIG. 4, the shot-blasting unit 6 is a known device that has a centrifugal fan that blows numerous abrasive grains 7 (a glass bead or a metallic particle, for example) against an outer surface of a workpiece. The electric wire 1 is fed and moved by the wire supply unit, and the shot-blasting unit 6 applies the abrasive grains to the portion of the outer surface of the electric wire 1 to be colored. The recesses 4 are continuously formed on the outer surface of the electric wire 1 so as to impart the irregularity thereupon.

After that, the electric wire 1, whose outer surface has the recesses 4 formed by the shot-blasting unit 6, is placed underneath the coloring unit by the wire supply unit, and then the coloring unit applies the coloring material 5 to the outer surface of the electric wire 1. Needless to say, the colored electric wire 10 obtained by the above shot-blasting and the subsequent coloring processes is the one illustrated in FIG. 1.

According to the present invention, the shot-blasting unit 6 is used to form the recesses 4 on the outer surface of the electric wire 1. In addition, the electric wire 1 is continuously fed without stoppage of the wire supply unit, and the recesses 4 can be continuously formed on the outer surface. Thus, manufacturability of the colored electric wire 10 will be improved.

Figure 5:
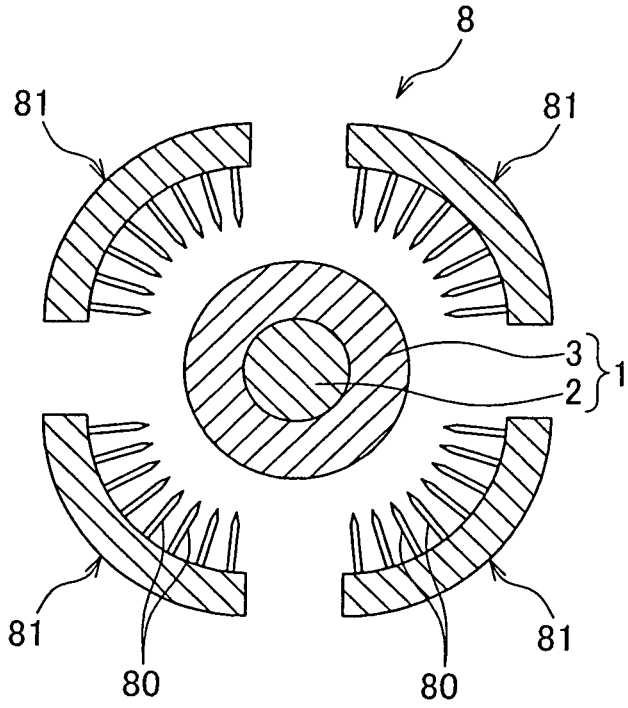
FIG. 5 illustrates the method for manufacturing the colored electric wire of FIG. 1 according to a second embodiment of the present invention.
Figure 6:
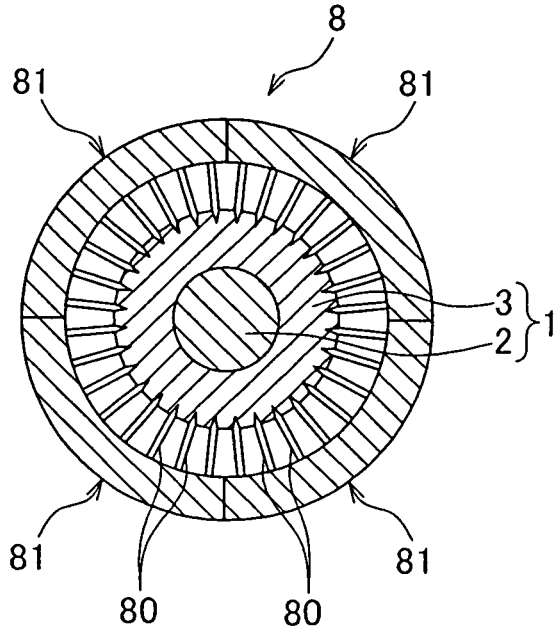
FIG. 6 illustrates the method for manufacturing the colored electric wire of FIG. 1 according to the second embodiment of the present invention.

The method for manufacturing the colored electric wire according to the present invention involves another approach to providing the irregularity of surface. The following describes the second embodiment of the present invention with reference to FIGS. 5 and 6. Although FIGS. 5 and 6 are dedicated to the second embodiment, the reference signs (i.e., 1, 2, and 3) in the first embodiment also appear in FIGS. 5 and 6 to indicate the same features as in the first embodiment. Accordingly, the description pertaining to the subject matter common to both embodiments will not be reiterated in the following paragraphs.

Referring to FIGS. 5 and 6, the recesses 4 are formed on the outer surface of the electric wire 1 using a hole-making unit 8. After that, the coloring material 5 is applied to the outer surface on which the recesses 4 have been formed using a coloring unit (not shown). Thus, the colored electric wire 10 illustrated in FIGS. 1 and 2 can be obtained.

The hole-making unit 8 has hole-making members 81 having needles 80 like a pinholder used in Ikebana (Japanese flower arrangement), and a moving unit (not shown) that moves the hole-making members 81 close to and away from the electric wire 1, i.e., radially inwardly and outwardly of the electric wire 1. As shown in FIG. 5, the hole-making unit 8 according to the second embodiment has the four hole-making members 81 that surround the electric wire 1.

Still referring to FIGS. 5 and 6, with the electric wire 1 residing at the center of a circle formed by the four hole-making members 81 (see FIG. 5), the hole-making unit 8 controlled by the moving unit makes the hole-making members 81 approach the electric wire 1 until the outer surface of the electric wire 1 is pricked with the needles 80 and the predetermined degree of irregularity or roughness of the outer surface is imparted by the recesses 4 around the entire periphery of the electric wire 1 (see FIG. 6).

According to the present invention, the outer surface of the electric wire 1 is pricked with the needles 80 to impart the irregularity of the outer surface, i.e., the plurality of the recesses 4. Accordingly a number and a depth of the recesses 4 can be controlled with precision by the moving unit.

Also, in the first and second embodiment of the present invention, the shot-blasting unit 6 and the hole-making unit 8 are used to form the recesses on the outer surface of the electric wire 1. Nevertheless, as an alternative approach, an operator may manually press the hole-making members 81 onto the electric wire 1 to provide the irregularity, or more specifically, the recesses 4 on the outer surface of the electric wire 1.

It should be noted that the embodiment described above is illustrated as an example of the possible embodiments of the present invention, and that numerous modifications and variations can be effectuated within the spirit and scope of the present invention.

What is claimed is:

1. A method for manufacturing a colored electric wire by coloring a portion of an outer surface of an insulating jacket of an electric wire covering an electrically-conductive core wire thereof, the method comprising the successive steps of: (a) feeding and moving by a wire supply unit the electric wire in a longitudinal direction thereof; (b) marring a surface of at least a portion of the outer surface fed and moved by the wire supply unit and thereafter; (c) applying by a coloring unit a coloring material to the portion of the outer surface of the insulating jacket on which the irregularity has been formed, wherein, in the step of (b), abrasive grains are blown by a shot-blasting unit against the portion of the outer surface of the insulating jacket so as to mar the surface.

2. A method for manufacturing a colored electric wire by coloring a portion of an outer surface of an insulating jacket of an electric wire covering an electrically-conductive core wire thereof, the method comprising the successive steps of: (a) feeding and moving by a wire supply unit the electric wire in a longitudinal direction thereof; (b) marring a surface of at least a portion of the outer surface fed and moved by the wire supply unit and thereafter; (c) applying by a coloring unit a coloring material to the portion of the outer surface of the insulating jacket on which the irregularity has been formed, wherein, in the step of (b), a plurality of hole-malting members are moved close to the electric wire fed by the wire supply unit, the hole-making members having needles and surrounding the electric wire, and the portion of the outer surface is pricked with the needles so as to mar the surface such that a number and a depth of the recesses are controlled.

* * * * *